United States Patent [19]

Williams

[11] 4,056,223

[45] Nov. 1, 1977

[54] FOLDABLE CONTAINER AND BLANK THEREFOR

[75] Inventor: Michael M. Williams, Arlington, Tex.

[73] Assignee: Packaging Corporation of America, Evanston, Ill.

[21] Appl. No.: 713,540

[22] Filed: Aug. 11, 1976

[51] Int. Cl.[2] ..... B65D 5/22

[52] U.S. Cl. ..... 229/32

[58] Field of Search ..... 229/32, 33

[56] References Cited

U.S. PATENT DOCUMENTS

| | | | |
|---|---|---|---|
| 1,207,899 | 12/1916 | Greve | 229/33 |
| 1,653,116 | 12/1927 | Parks | 229/32 |
| 1,936,136 | 11/1933 | Lindgren | 229/32 X |
| 2,801,740 | 8/1957 | Fallert | 229/32 X |
| 3,034,698 | 5/1962 | Forrer | 229/32 |
| 3,343,744 | 9/1967 | Morell et al. | 229/33 |
| 3,529,763 | 9/1970 | Wagner | 229/37 R |

*Primary Examiner*—Davis T. Moorhead

*Attorney, Agent, or Firm*—Neuman, Williams, Anderson & Olson

[57] ABSTRACT

A foldable container having reinforced corners is provided. The container includes a bottom section which is delimited by upright side and end panels. The side and end panels are foldably connected to the periphery of the bottom section and cooperate therewith to form an open top product-accommodating compartment. Pairs of corner-reinforcing members are foldably connected to the edges of each end panel adjacent the side panels. Each corner-reinforcing member is provided with a first section connected to the end panel edge and partially overlying and being secured to the interior surface of the adjacent side panel. A second section is connected to the first section and is secured thereto in at least a partial foldback relation. A third section is connected to the second section and is secured in partially overlying relation with the interior surface of the end panel.

6 Claims, 10 Drawing Figures

FOLDABLE CONTAINER AND BLANK THEREFOR

BACKGROUND OF THE INVENTION

The packaging in a single container of heavy and bulky products (e.g., a plurality of film-wrapped cuts of meat) presents certain problems which must be overcome so as not to have a deleterious effect on the product which in turn might seriously impair its marketability. The total weight of the plurality of the film-wrapped cuts of meat is oftentimes 60–70 pounds and such cuts are shipped to the merchant (supermarket operator) for final portion cutting. Because of the perishable nature of the product it must be refrigerated while in storage and/or in shipment. Thus, after the film-wrapped products have been packaged in a container the latter is normally arranged in stacked relation with other similarly packaged products and the stack is then placed in refrigerated storage or in refrigerated trucks or the like.

Because of the stacked arrangement certain of the containers are subjected to substantial compressive forces which in the past have frequently caused collapse or severe distortion of the lower containers resulting in accidental exposure of the product and even, in some instances, causing the film wrapper to be torn.

In normal warehousing or storage operations the stacked containers are palletized thereby enabling the entire stack to be readily moved about by lift trucks. Where, however, the lower containers of the stack are collapsed or severely distorted, the stability of the stack is seriously impaired thereby causing a serious hazard to personnel operating within the facility.

Furthermore, in the packaging of certain products having substantial weight, difficulty is oftentimes encountered in properly closing the container either manually or by mechanical means, because of bulging or distortion of the side or end walls thereof due to the weight of the product itself. Thus, the cost, time and effort required to package the product were significantly increased.

In order to attain the necessary strength and rigidity of the containers used for such packaging, it has heretofore been necessary in many instances for the container to be formed of heavy gauge costly material and/or for special reinforcing inserts to be positioned within the container adjacent the corners thereof. Oftentimes with certain prior structures it was necessary for the container to be performed by the manufacturer and shipped and/or stored in such condition prior to being loaded with the product. In this latter situation storage of the empty preformed containers required an inordinate amount of space. Furthermore, because of certain design characteristics, numerous prior containers were not capable of accommodating a variety of products.

SUMMARY OF THE INVENTION

Thus, it is an object of the invention to provide a foldable, inexpensive, yet sturdy, container which is not beset with the aforenoted shortcomings associated with prior containers of this general type.

It is a further object of the invention to provide a foldable container which is formed from a single blank of inexpensive foldable sheet material having a simple configuration and capable of being produced by conventional automatic high speed slotting, slitting and scoring equipment.

It is a still further object of the invention to provide a foldable container which, prior to use, may be stored or shipped in a completely unfolded or partially folded but collaped condition.

It is a still further object to provide a foldable container which may be readily set up and loaded with automatic or semi-automatic high speed equipment.

It is still a further object to provide a foldable container which has an inordinately high top to bottom strength without requiring heavy gauge, expensive, high strength material and/or the utilization of corner inserts or the like.

Further and additional objects will appear from the description, accompanying drawings and appended claims.

In accordance with one embodiment of the invention, a foldable container formed from a single blank of sheet material is provided which has reinforced corners. The container includes a bottom section delimited by pairs of upright end panels and side panels. The panels are foldably connected to peripheral segments of the bottom section and cooperate with the latter to form an open top product-accommodating compartment. The edge of each end panel, adjacent a side panel, has foldably connected thereto a corner-reinforcing member. The member includes a first section connected to the end panel edge and being secured in partially overlying relation with the interior surface of the adjacent side panel. The member also includes a second section connected to the first section and secured thereto in at least a partial foldback overlying relation with the first section. A third section is connected to the second section and is secured in partially overlying relation to the interior surface of the end panel.

DESCRIPTION

For a more complete understanding of the invention reference should be made to the drawings wherein.

Figure 4:
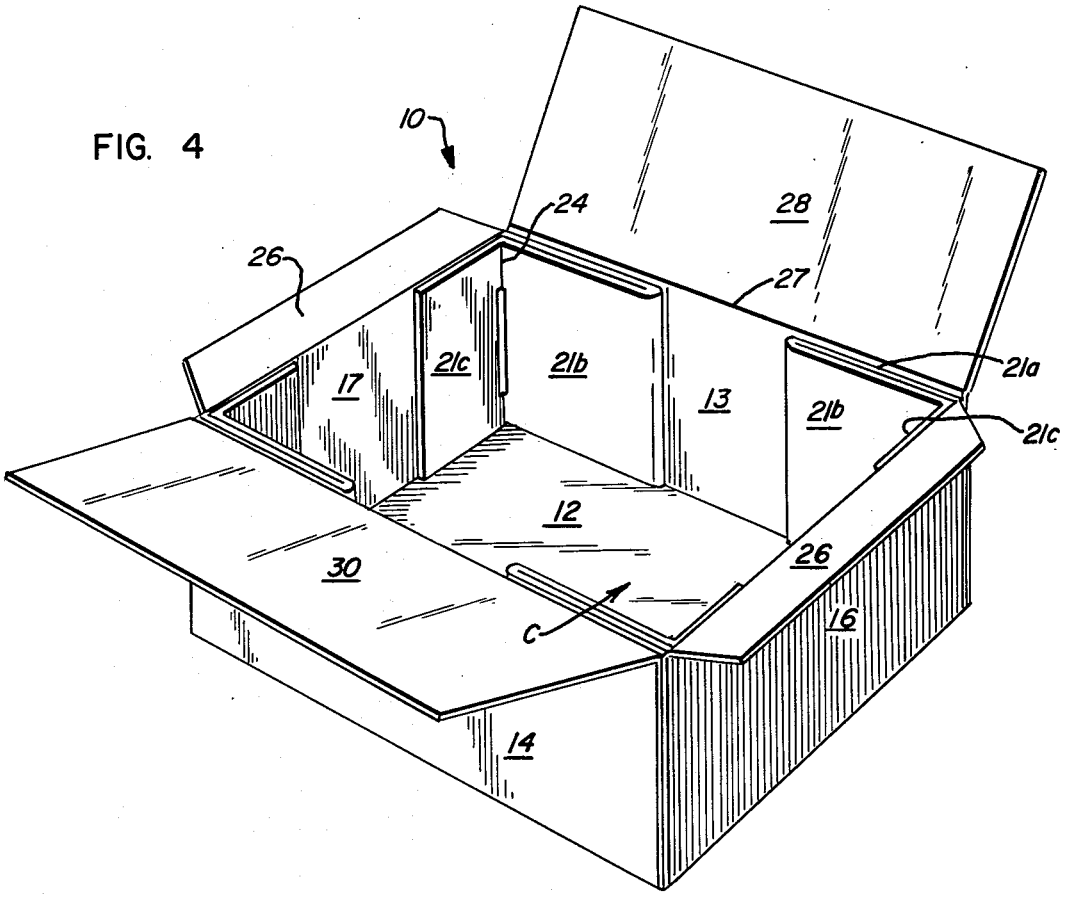
FIG. 4 is similar to FIGS. 2 and 3 and showing the one form of the improved container set up for loading.

Referring now to the drawings and more particularly to FIG. 4, one form of the improved container 10 is shown set up for loading. Container 10 is formed from a single blank 11 (FIG. 1) of sheet material such as double faced corrugated fibreboard commonly used for shipping containers, boxes and the like. The sheet material is strong, yet inexpensive and the blank 11 may be readily formed by conventional, automatic, high speed slotting, slitting and scoring equipment. Furthermore, it will be noted in forming blank 11 and modified blank 111, FIG. 5, that there is a minimal amount of material waste, thereby reducing the cost of either form of blank.

Blank 11 includes a bottom section 12, preferably of rectangular configuration, a pair of side panels 13 and 14 connected by foldlines 15 to the opposite elongated peripheral segments of section 12, and a pair of end panels 16 and 17 connected by foldlines 18 to the opposite narrow peripheral segments of section 12. Foldlines 15 are transversely disposed relative to foldlines 18.

Connected by foldlines 20 to the opposite ends of each end panel are corner-reinforcing members 21 and 22. Members 21 and 22 are of like configuration and in the illustrated embodiment, a pair of members is provided for each end panel 16, 17. If desired, however, the corner-reinforcing members in a given container may vary in size and configuration, as will be discussed more fully hereinafter. The size and configuration of the corner-reinforcing members will depend to a substantial extent on the type of product to be accommodated within the container.

Each corner-reinforcing member in blank 11 includes a first section 21*a*, 22*a* which is connected along one side by foldline 20 to the adjacent end of the end panel 16, 17. Connected to the opposite side of the first section of a foldline 23 is a second section 21*b*, 22*b*. The first and second sections of each corner-reinforcing member 21, 22 in the illustrated blank 11 are of substantially like configuration and size. The opposite side of the second section 21*b*, 22*b* is connected by a foldline 24 to a third section 21*c*, 22*c*. To facilitate folding of the third section relative to the second section, foldline 24 may be interrupted by an elongated slot 24*a*.

Figure 1:
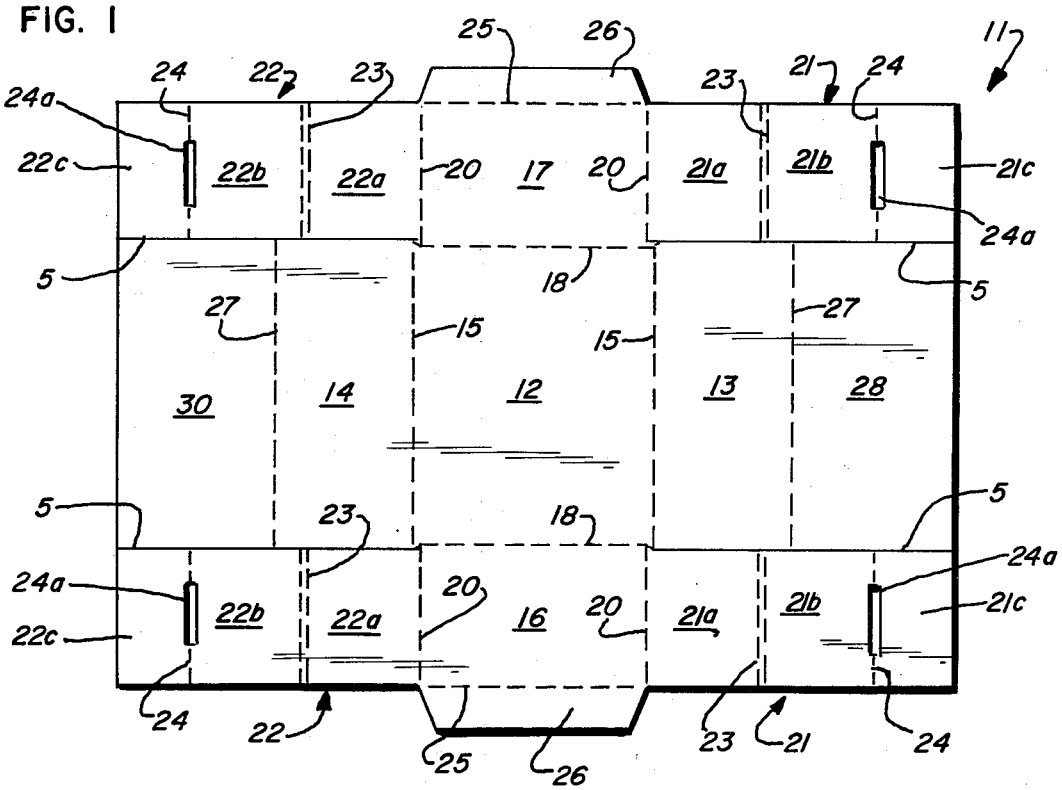
FIG. 1 is a top plan view of a blank for one form of the improved container.

It will be noted in FIG. 1 that the sections comprising each corner-reinforcing member are arranged in side by side relation and that the foldlines 20, 23 and 24 are in substantially parallel relation to each other.

Connected by a foldline 25 to the outer edge of end panel 16, 17 is a tuck flap 26, the function of which will become apparent from the discussion hereinafter.

Connected by foldline 27 to the outer elongated edge of each side panel 13, 14 is a top closure panel 28, 30, respectively. Foldlines 15 and 27 are in substantially parallel relation. The side panel and the connected top closure panel are separated at opposite ends from the corresponding corner-reinforcing members by elongated slits S which extend from the periphery of the blank itself to the corresponding end panels 16, 17.

Figure 2:
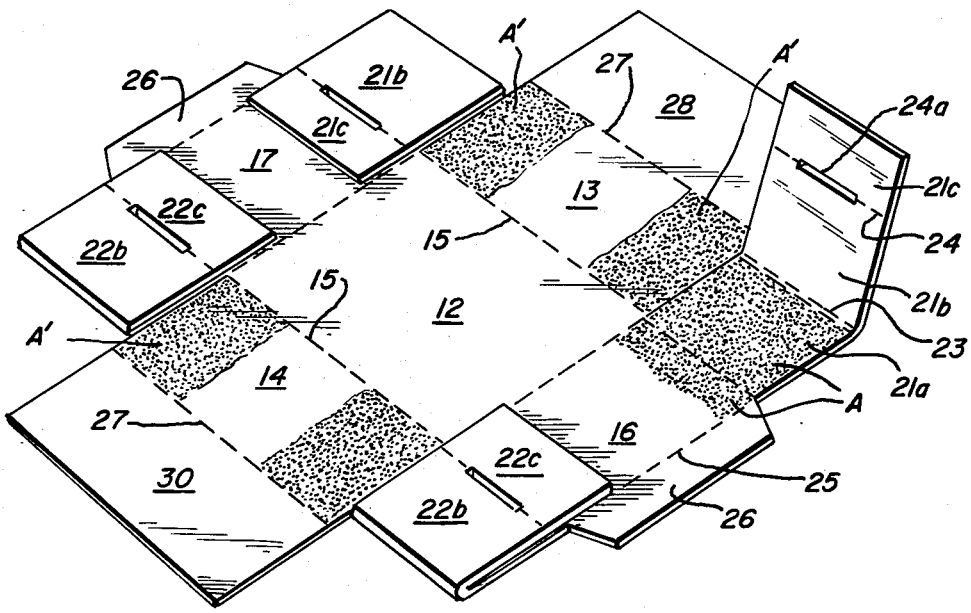
FIGS. 2 and 3 are perspective top views showing successive stages of setting up the blank of FIG. 1.
Figure 3:
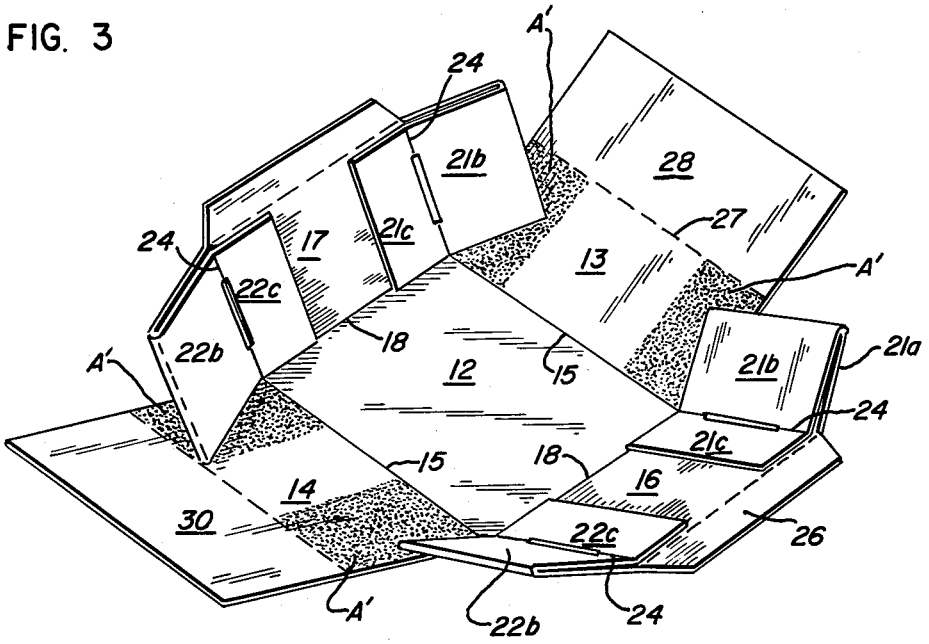

FIG. 2 shows the first step in setting up the blank 11 to form the container 10. Each member 21, 22 has the second and third sections 21*b*, 21*c* and 22*b*, 22*c* thereof folded as a unit about foldline 23 so that the second section 21*b*, 22*b* will overlie the corresponding first section 21*a*, 22*a* and the third section 21*c*, 22*c* will partially overlie the interior surface of the adjacent end panel 16, 17. The overlying sections may be secured in place by a suitable adhesive or the like. Once the sections are secured in proper overlying relation as seen in FIG. 2, foldlines 20, 24 will be in superposed or coextensive relation. The adhesive patterns A and A' shown by stippling in FIG. 2, may be applied by automatic gluing equipment or manually at the time the blank is to be set up for loading. In certain instances pattern A would be applied at the time the blank is formed and the corner-reinforcing member folded as shown in FIG. 2. In such a situation pattern A' would be applied when the blank is to be set up for loading, FIG. 4.

With the blank 11 in either fully unfolded condition (FIG. 1) or in its partially folded or collapsed state (FIG. 2), it may be readily stored or shipped with a plurality of like blanks without occupying an inordinate amount of space.

When the blank 11 is to be set up for loading, FIG. 4, from the partially folded condition, FIG. 2, the corner-reinforcing members 21*a*, 21*b* and 22*a*, 22*b* will be folded upwardly about the foldlines 24 and then each end panel with the folded corner-reinforcing members attached thereto is folded upwardly as a unit about foldline 18.

The adhesive pattern A' may have been applied to side panels 13, 14, prior to folding of sections 21*a*, 21*b* and 22*a*, 22*b* about foldlines 24, or after the end panels and associated corner-reinforcing members have been folded as a unit about foldlines 18.

After the end panels and associated corner-reinforcing members have assumed their upright positions relative to bottom section 12, the side panels 13 and 14 with the adhesive pattern A' applied thereto, is folded to upright substantially parallel positions about foldlines 15. Once the side panels are so disposed, the exterior surfaces of sections 21*a*, 22*a* of the corner-reinforcing members will be bonded to the adjacent side panels by reason of the adhesive pattern A'. The inherent tendency of the folded sections 21*a*, 21*b* and 22*a*, 22*b* to return to their partially folded state, FIG. 2 will assure a good bond between the side panels and the member sections 21*a*, 22*a*. By reason of the corner-reinforcing members being bonded to both the end of side walls, the resistance of the walls to distort or bulge when loaded and when arranged in stacked relation is markedly increased.

When the container 10 is set up for loading, FIG. 4, the side and end panels, and the associated corner-reinforcing members cooperate with the bottom section 12, so as to form an open-top compartment C into which the product is loaded, either manually or by automatic or semi-automatic loading equipment. As aforementioned, the loaded product may be a plurality of large, individually film-wrapped cuts of meat having a total weight of approximately 60–70 pounds.

Once the loading of the product has been completed, the tuck flaps 26 may be folded inwardly about foldlines 25 so as to overlie the accommodated product. Closure panels 28, 30 are then folded inwardly about foldlines 27. If the closure panels are sized so that they overlap, then the overlapped portions are secured to one another by tape or adhesive. On the other hand, if the elongated free edges assume a substantially abutting relation, the joint formed therebetween may be covered over by a tape section in a manner well known in the art.

The adhesive patterns A and A' may be either stripes, spots, or entire areas and applied by brush, wheels or spraying, as will be described more fully hereinafter.

Figure 8:
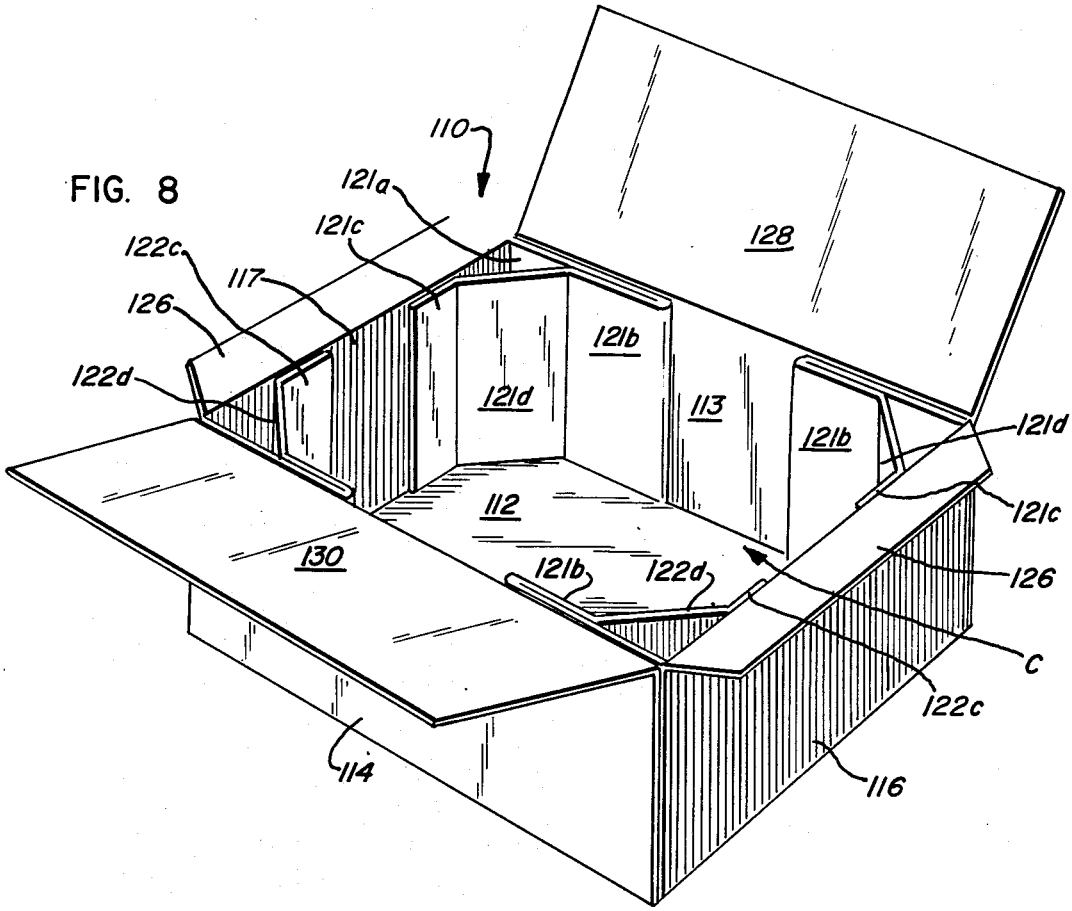
FIG. 8 is similar to FIG. 4 but showing the second form of the improved container set up for loading.

It will be noted in FIG. 4 that compartment C has a substantially rectangular configuration which may be sized so as to readily accommodate a product of similar size and shape. Where, however, the accommodated product is of substantial weight as to require increased corner reinforcement, a container 110, shown in FIG. 8 might be employed.

Containers 10 and 110 substantially the same except for the corner-reinforcing members which are foldably connected to the end panels. Accordingly, portions of container 110 which correspond to portions of container 10 will be given the same numbers except in the one hundred series. In view of the fact containers 10 and 110 only differ primarily in the corner-reinforcing members, only such members will be discussed in detail hereinafter. Reinforcing members 121 and 122 in container 110 are foldably connected by foldlines 120 to opposite ends of each end panel 116, 117. In the illustrated embodiment, members 116, 117 are of like configuration; however, this is not essential, as previously mentioned with respect to container 10 and will depend upon the type of product to be packaged.

Each member 121, 122 includes a first section **121*a*, 122*a* connected to the end panel 116, 117 by foldline 120. A second section 121*b*, 122*b* is connected to the opposite side of the first section by a foldline 123. Disposed on the opposite side of the second section 121*b*, 122*b* and connected thereto by a foldline 131 is a chordlike section 121*d*, 122*d*. The section 121*d*, 122*d* separates the second section 121*b*, 122*b* from a third section 121*c*, 122*c*. As noted in FIG. 5, the sections comprising each corner-reinforcing member 121, 122 are disposed in aligned side by side relation and the foldlines 120, 123, 131 and 124** are in substantially parallel relation.

Figure 6:
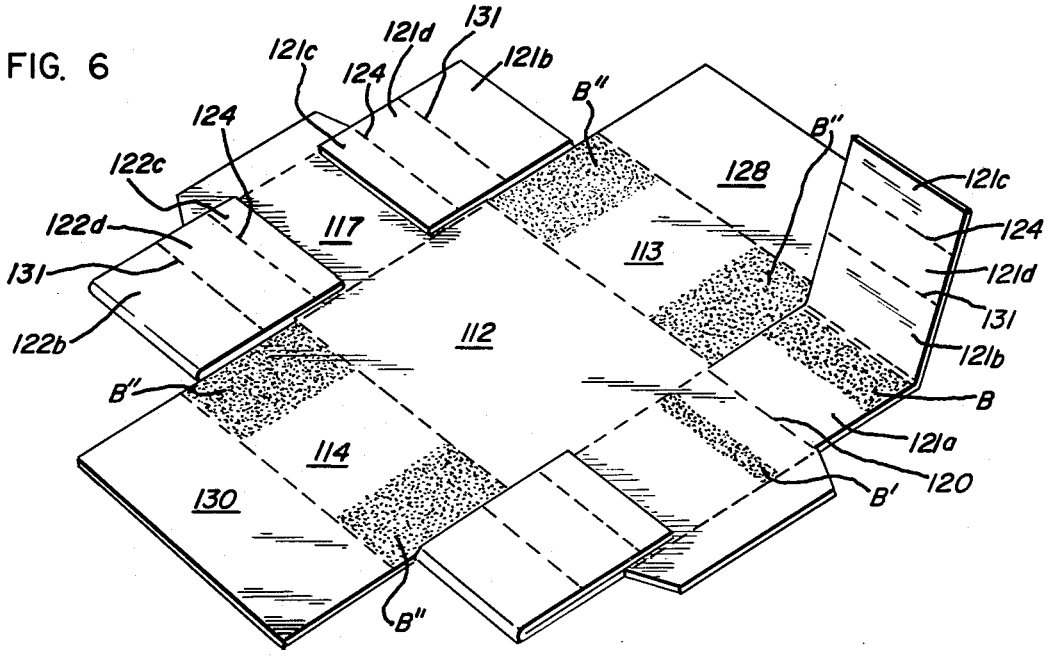
FIGS. 6 and 7 are similar to FIGS. 2 and 3 but showing the modified blank in successive stages of set up.
Figure 7:
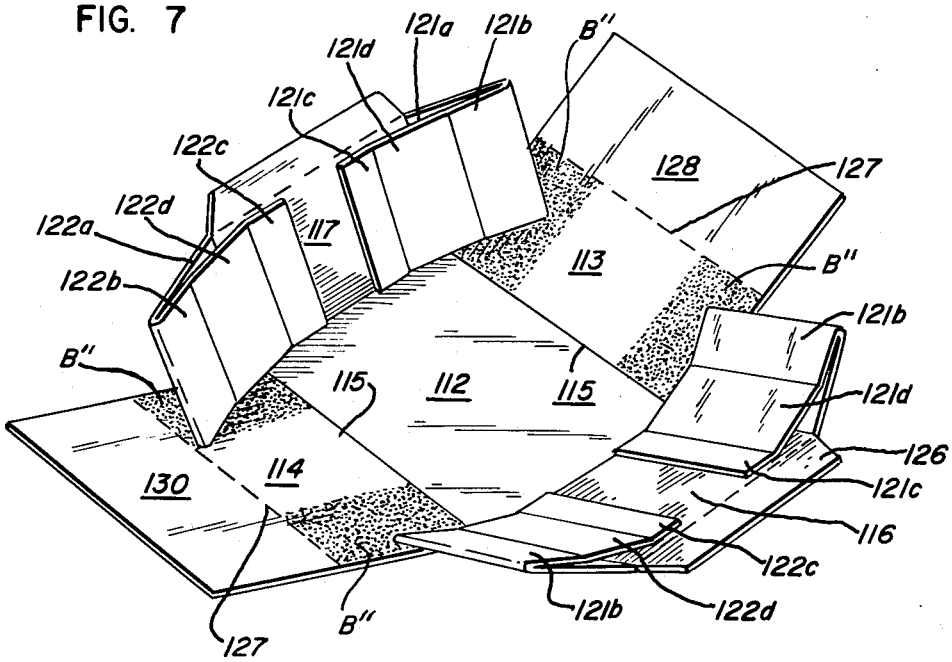

The procedure for setting up blank 111 into the container 110 is the same as that hereto described with respect to blank 11. The only difference between the two procedures is that in blank 111, the adhesive pattern applied to the first section **121*a*, 122*a* of each reinforcing member and the adjacent end panel 116, 117 comprises two relatively spaced areas B and B′ disposed on opposite sides of foldline 120. The spacing between areas B and B′ has a shape which corresponds substantially to the configuration of the chordlike section 121*d*, 122*d* which initially will overlie same, see FIG. 6. Thus, because of the adhesive-free spacing between areas B, B′, the section 121*d*, 122*d* of each corner-reinforcing is free to assume a diagonal position between corresponding portions of the side and end panels when the blank is set up to form the container 111, see FIG. 8.**

The adhesive pattern B″ applied to the side panels 113, 114 is the same as the adhesive pattern A′ of blank 11.

Thus, chordlike sections **121*d*, 122*d* are spaced inwardly from the adjacent corners formed by the intersecting planes of the side and end panels. The extent to which the chordlike sections are spaced inwardly from the corner will depend upon the spacing between the foldlines 124, 131 which define opposing sides of each section 121*d*, 122*d*. The four chordlike sections 121*d*, 122*d*** cooperate with one another so as to reduce the size of the area for the accommodated product and to increase materially reinforcement of the corners of the container.

While both containers 10, 110 show like corner-reinforcing members in a given container, it is to be understood of course that this is not essential. For example, two corners might be reinforced by members 21 and the remaining corners reinforced by members 121. The particular arrangement will depend upon the type, weight, size and shape of the product being packaged. In a like manner the size and shape of the side and end panels may be varied from that shown.

Figure 5:
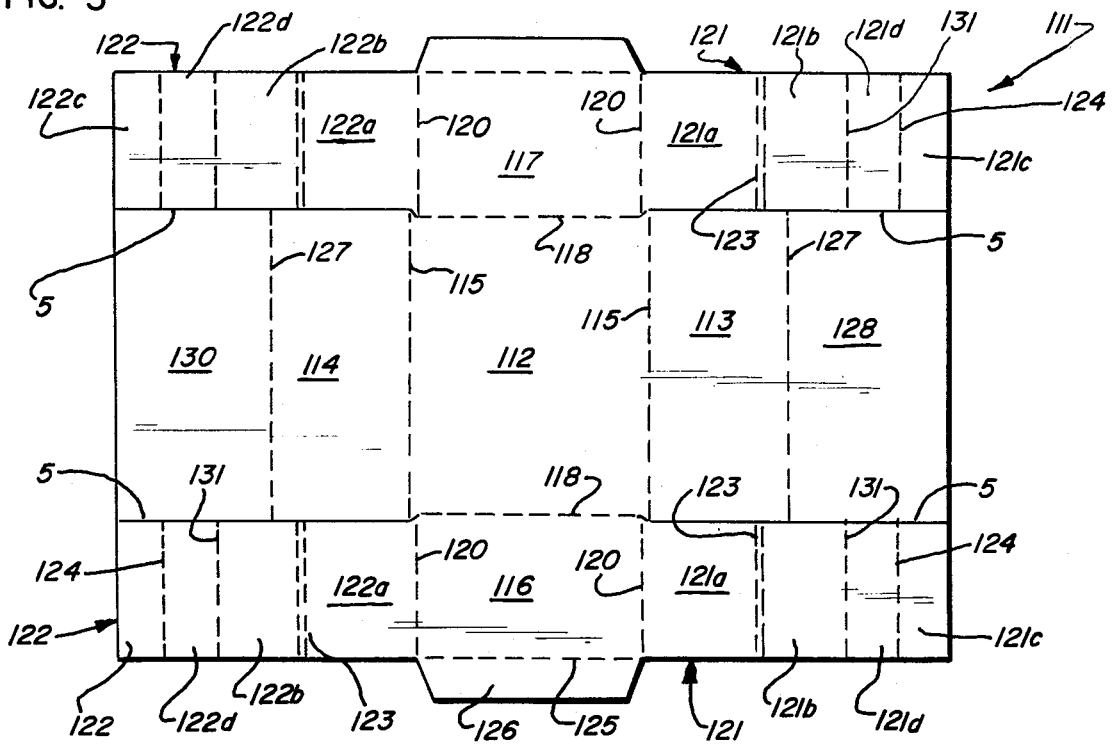
FIG. 5 is similar to FIG. 1 but showing a modified blank for a second form of the improved container.
Figure 9:
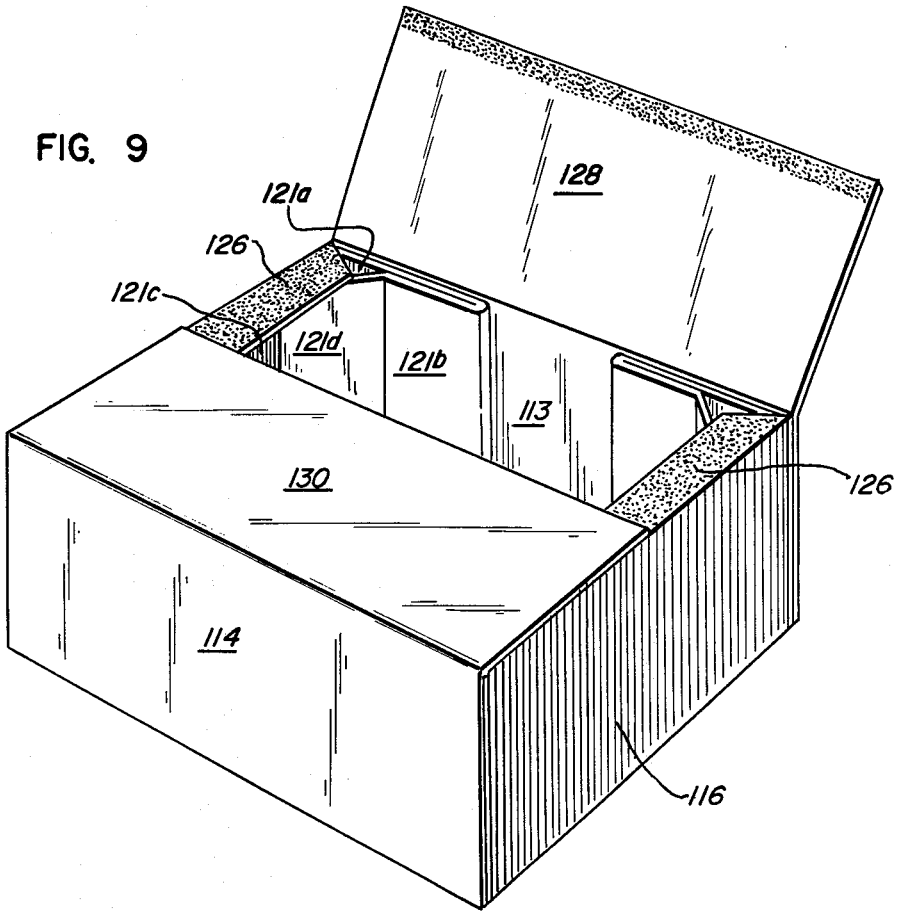
FIG. 9 is a perspective top view of the container of FIG. 8 subsequent to being loaded and showing the top closure panels in a partially folded top closing relation.

Once container 110 has been loaded the top closure panels 128, 130 and flaps 126 may be folded relative to one another as seen in FIG. 9 to effect closing of the carton. It will be noted in FIG. 9 that flaps 126 are folded inwardly and subtend panels 128, 130 and are secured to the latter. If desired, however, panels 128, 130 may be first folded inwardly and then the flaps 126 folded so as to overlie and be secured to the outer surface of the previously folded panels 128, 130.

Where the blank 11 or 111 is shipped to the customer in a completely unfolded condition, as seen in FIGS. 1 and 5, the customer will normally store the blank in such condition until such time as the blank is to be set up for loading. In such a situation, the adhesive patterns are applied to the blank by automatic or semi-automatic equipment and the blank immediately set up for loading. The two-step operation, namely, application of the adhesive and setting up of the blank, is a continuous uninterrupted procedure. Equipment for performing such operations is diagrammatically shown in FIG. 10. At station I, a plurality of blanks are arranged in superposed, stacked relation and blanks are successively removed from the stack by suction means or the like in a manner well known in the art. Station I is optional and may be omitted where other well-known means is utilized for feeding the blanks to station II. At station II suitable adhesive is automatically applied to the blank surface in accordance with the desired adhesive pattern, see FIGS. 2 and 6. Various applicators for the adhesive or hot melt well known in the art may be employed for this purpose. Subsequent to the application of the adhesive, the blank is then fed to a station III wherein the set up (folding) of the various flaps, end walls and side walls of the blank occurs. If desired, the folding of the flaps (reinforcing sections) 21, 22 or 121, 122 may occur while the blank is disposed at station II, or as the blank is being moved from station II to station III.

Where, however, hot melt is to be utilized, the hot melt may be first applied to the end walls at station II and then additional hot melt applied to the side walls at station III prior to the folding of the side walls relative to the reinforcing members **21*a*, 22*a* and 121*a*, 122*a*.** The stations I, II and III are preferably disposed within a single frame F thereby forming a compact unit normally located within the customer's plant.

Figure 10:
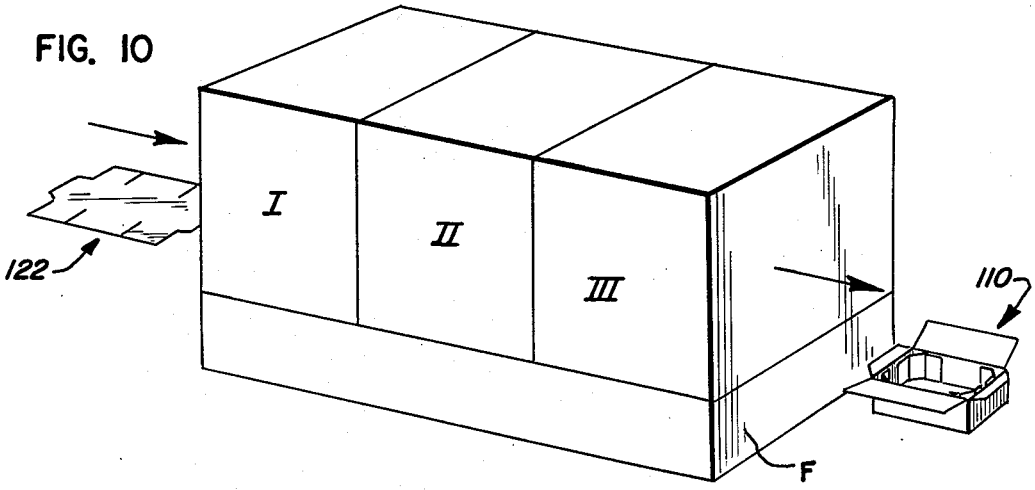
FIG. 10 is a fragmentary diagrammatic view of one form of gluing and set up equipment and showing the unfolded blank being inserted at one end of the equipment and being discharged from the opposite end of the equipment in set up condition ready for loading.

Thus, with the equipment disclosed and shown in FIG. 10, the gluing and folding operations are performed with only one pass of the blank through the equipment thereby markedly reducing the time and effort involved in such an operation and eliminating the need for storing and/or shipping empty containers in a fully set up state.

Once the container has been set up it is moved to a loading station, not shown, and then a closing station, also not shown but well understood in the art.

Thus, it will be seen that a foldable container formed from single blank of inexpensive sheet material has been provided which is capable of accommodating a wide variety of products varying in size, shape and weight over a wide range. The blank may be readily formed with conventional, automatic, high-speed, slotting, slitting, and scoring equipment. The blank can be stored and/or shipped in a fully unfolded state, thereby occupying a minimum amount of space. Furthermore, the blank may be glued and set up either manually or by a single pass through automatic equipment. The container is highly resistant to crushing or distortion and thus, may be used in instances where stacking strength is important.

I claim:

1. A foldable container formed from a single blank of sheet material and having at least one reinforced corner, said container comprising a bottom section; end and side panels foldably connected respectively to first and second peripheral segments of said bottom section and extending upright therefrom and delimiting an open top, said upright end and side panels forming at least one corner therebetween; a top closure flap foldably connected to at least one of said side panels; and a corner-reinforcing member foldably connected to an edge of the end panel adjacent said corner, said corner-reinforcing member including a first section foldably connected to the end panel edge and having a surface thereof secured to an interior surface of the adjacent side panel, a second section having a first portion foldably connected to said first section and secured to the opposite surface thereof in foldback relation and a second portion foldably connected to said first portion and extending angularly therefrom and disposed in inwardly spaced relation with respect to said end panel edge, and a third section foldably connected to said second portion and secured to the interior surface of said end panel.

2. The foldable container of claim 1 wherein the upright end and side panels form four corners therebetween and a corner-reinforcing member is provided for each of said corners.

3. The foldable container of claim 2 wherein the end and side panels have the same height measured from the bottom section, and all of the sections of the corner-reinforcing member have the same height as said end and side panels.

4. The foldable container of claim 3 wherein each side panel has a top closure flap foldably connected thereto, and each end panel has a tuck flap foldably connected thereto, said top closure and tuck flaps coacting with one another to form a closed top.

5. A blank of foldable sheet material for use in forming a container having a closeable top and reinforced corners, said blank comprising a bottom section; side panels connected by first foldlines to opposite peripheral segments of said bottom section, top closure flaps connected by second foldlines to said side panels, said first and second foldlines being in spaced substantially parallel relation; end panels connected by third foldlines to opposite peripheral segments of said bottom section, said side and end panels delimiting said bottom sections; and pairs of corner-reinforcing members connected by fourth foldlines to opposite peripheral segments of each end panel, said fourth foldlines being substantially parallel to said second foldines, each corner-reinforcing member being adjacent a side panel and top closure flap and separated therefrom by an elongated slit; each corner-reinforcing member including foldably connected sections arranged in side by side relation and extending from the end panel peripheral segment a distance substantially equal to the combined dimensions of the adjacent side panel and top closure flap measured normal to said first foldline.

6. The blank of claim 5 wherein the length of each fourth foldline is substantially equal to the dimension of the end panel measured normal to said third foldline.

* * * * *

UNITED STATES PATENT AND TRADEMARK OFFICE

CERTIFICATE OF CORRECTION

PATENT NO. : 4,056,223

DATED : NOVEMBER 1, 1977

INVENTOR(S) : MICHAEL M. WILLIAMS

It is certified that error appears in the above-identified patent and that said Letters Patent are hereby corrected as shown below:

Column 2, line 5 - "a still" should be --still a--

Column 3, line 6 - after "of" (1st occurrence) insert --bottom--

Column 3, line 25 - "of" should be --by--

Column 4, line 29 - "of" should be --and--

Column 8, line 16 - "foldines" should be --foldlines--

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*